United States Patent [19]

Urata et al.

[11] Patent Number: 4,653,310

[45] Date of Patent: Mar. 31, 1987

[54] DIE ASSEMBLY FOR USE IN GENERAL TYPE MECHANICAL PRESS MACHINE

[75] Inventors: Chieo Urata; Yasuo Suzuki, both of Komatsu, Japan

[73] Assignee: Kabushiki Kaisha Komatsu Seisakusho, Tokyo, Japan

[21] Appl. No.: 597,921

[22] Filed: Apr. 9, 1984

[30] Foreign Application Priority Data

May 25, 1983 [JP] Japan ..... 58-090821

[51] Int. Cl.[4] ..... B21J 5/00; B21J 9/18

[52] U.S. Cl. ..... 72/407; 72/354; 72/360; 72/453.03; 72/449; 72/450

[58] Field of Search ..... 72/354, 360, 353, 449, 72/450, 453.03, 407

[56] References Cited

U.S. PATENT DOCUMENTS 290,449 12/1883 Meatyard ..... 72/407

1,979,931 11/1934 Beche ..... 72/407

4,274,276 6/1981 Mettler ..... 72/354

FOREIGN PATENT DOCUMENTS 0026652 3/1981 Japan ..... 72/360

*Primary Examiner*—Robert L. Spruill

*Assistant Examiner*—Steve Katz

*Attorney, Agent, or Firm*—Frost & Jacobs

[57] ABSTRACT

A die assembly for use in a general type mechanical press machine has opposite upper and lower dies adapted to be fitted in upper and lower die sets, respectively, so as to be slidable freely by a predetermined stroke, and a differential mechanism interposed between the upper and lower dies so as to transmit a predetermined rate of displacement to the lower die in accordance with the movement or displacement of the upper die set. The differential mechanism comprises a rack and pinion mechanism or linkage having two pair of link mechanisms.

4 Claims, 7 Drawing Figures

DIE ASSEMBLY FOR USE IN GENERAL TYPE MECHANICAL PRESS MACHINE

BACKGROUND OF THE INVENTION

1. Field of the invention:

This invention relates to a die assembly for use in a press machine, particularly in a general type mechanical press machine in which a slide or ram is moved mechanically through a mechanism such as, for example, crank, eccentric, knuckle, toggle, link, cam, etc.

2. Description of the prior art:

Conventional general type mechanical press machines are adapted to shape a product between an upper die mounted on a slide and a lower die fixedly secured to a bolster by the pressurization of the upper die during its downward movement. In such press machines, products cannot be shaped by synchronous movements of the upper and lower dies towards each other. To achieve shaping of a product by synchronous movements of the upper and lower dies towards each other, the use of a special drive press or a press machine of servo control drive system in which a computer is employed is required, thus causing various disadvantages such as increasing in the dimension of the whole system, increasing in the shaping cost of products and increasing in the work cycle time etc.

SUMMARY OF THE INVENTION

The present invention has been devised in view of the above-mentioned circumstances in the conventional general type mechanical press machines.

It is an aspect of the present invention to provide a die assembly for use in a general type mechanical press machine wherein synchronous movements of upper and lower dies towards each other can be made readily.

It is another aspect of the present invention to provide a general type mechanical press machine capable of reducing the manufacturing or shaping cost of products.

It is a further aspect of the present invention to provide a general type mechanical press machine wherein shaping work can be carried out in a short work cycle time that is nearly the same as those of ordinary type press machines.

To achieve the above-mentioned aspects, according to the present invention, there is provided a die assembly for use in a general type mechanical press machine characterized by comprising opposite upper and lower dies adapted to be fitted in upper and lower die sets, respectively, so as to be slidable freely by a predetermined stroke, and a differential mechanism interposed between said upper and lower dies so as to transmit a predetermined rate of displacement to said lower die in accordance with the movement or displacement of said upper die set.

According to a further aspect of the present invention, there is provided a die assembly for use in a general type mechanical press machine characterized in that said differential mechanism comprises pinion means rotatably supported by said lower die; a fixed rack fixedly secured to said lower die set and meshing with said pinion means; and a movable rack located on the opposite side of said fixed rack so as to mesh with said pinion means and adapted to be moved in synchronism with said upper die set.

Still further, according to the present invention, there is provided a die assembly for use in a general type mechanical press machine, characterized in that said differential mechanism comprises linkage means having two pairs of link mechanisms, each link mechanism comprising a pair of link members wherein respective one ends of said link members are pivotally connected to said upper and lower die sets, respectively, and respective other ends of said link members are pivotally connected to two arms fixedly secured to and horizontally extending on the left and right sides from the lower die in such a manner that said other ends of the link members are movable freely in the horizontal direction, but restrained in the movement in the vertical direction.

Still further, according to the present invention, there is provided a die assembly for use in a general type mechanical press machine, characterized in that said pinion means comprises a first sector and a second sector, wherein respective gear ratios of the first and second sectors being different from each other.

Still further, according to the present invention, there is provided a die assembly for use in a general type mechanical press machine, characterized in that said pinion means comprises two sets of pinions coaxially mounted on a shaft, wherein respective gear ratios of said two sets of pinions being different from each other.

Still further, according to the present invention, there is provided a die assembly for use in a general type mechanical press machine, characterized in that said respective one ends of the link members are pivotally connected to other two arms fixedly secured to and extending horizontally on the left and right sides from the upper and lower die sets.

The above and many other advantages, features and additional aspects of the present invention will become apparent to those skilled in the art upon making reference to the following description and accompanying drawings in which preferred structural embodiment incorporating the principles of the present invention are shown by way of illustrative example.

DETAILED DESCRIPTION OF THE PREFERRED EMBODIMENTS

Figure 1:
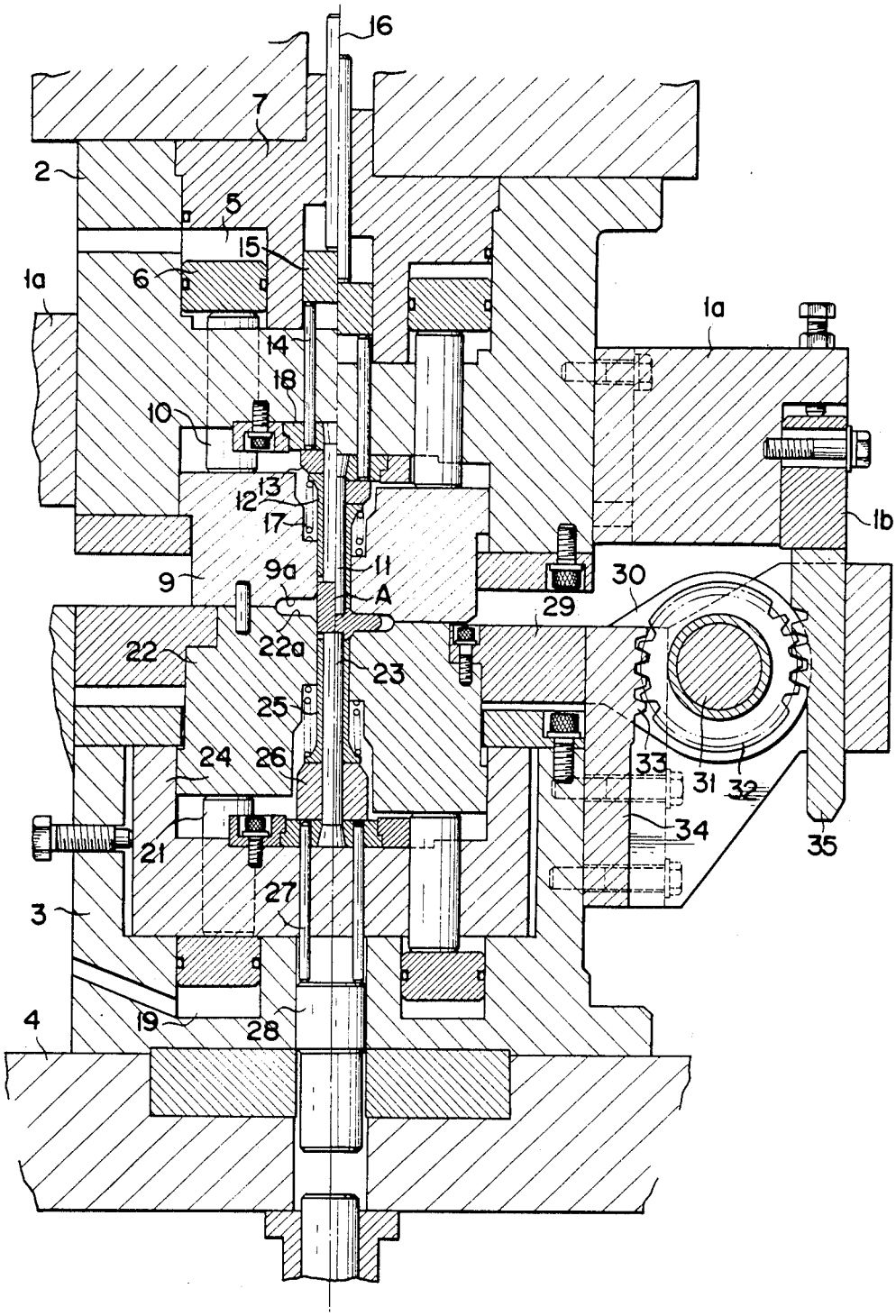
FIG. 1 is a longitudinal sectional view of the principal parts of the one embodiment of die assembly according to the present invention.

FIG. 1 shows the construction and operation of one embodiment of die assembly for use in a general type mechanical press machine according to the present invention, the left side of the centre line in the drawing showing the die assembly in the course of operation and the right side thereof showing the die assembly after it is actuated.

In the drawings, reference numeral 1 denotes an upper die set fixedly secured to the lower surface of a vertically movable slide 2. Reference numeral 3 indicates a lower die set fixedly secured to a bolster 4. The upper die set 1 has an annular fluid pressure chamber 5 formed therein. An annular piston 6 is mounted within the lower part of the fluid pressure chamber 5. Reference numeral 7 denotes a plate forming said fluid pressure chamber 5 and fixedly secured to the upper die set 1, and 9 an upper die set fitted in the lower end of the upper die set 1 so as to move freely by a predetermined stroke in the vertical direction. A plurality of, for example, six pieces of pins 10 are interposed circumferentially between the upper surface of the upper die and the aforementioned piston 6. Reference numeral 11 denotes an upper punch fitted in the axial bore of the upper die 9; 12 a ring knock-out in which the upper punch 11 is fitted; 13 a piece adapted to abut against the upper surface of the ring knock-out 12; 14 a knock-out pin adapted to abut against the upper surface of the piece 13; 15 a piece adapted to abut against the upper surface of the knock-out pin 14; 16 a knock-out bar adapted to abut against the upper surface of the piece 15; and 17 a spring for biasing the ring knock-out 12 upwards. The upper punch 11 is fixedly secured through a plate 18 to the upper die set 1.

The above-mentioned lower die set 3 includes, in the like manner as the upper die set 1, an annular fluid pressure chamber 19, a piston 20 fitted in the chamber 19, pins 21, a lower die 22, a lower punch 23, a holder 24 fixedly secured to the lower die set 3, a ring knock-out 25, a piece 26, a knock-out pin 27 and a knock-out bar 28 etc. The lower punch 23 is fixedly secured to the holder 24.

The above-mentioned upper and lower dies 9 and 22 have shaping molds **9*a* and 22*a*, respectively, in their respective opposite surfaces. The lower die 22 is vertically movable towards the holder 24 of the lower die set 3** by a predetermined stroke.

The above-mentioned die set 1 has blocks **1*a*, 1*a*, fixedly secured to both the left and right sides thereof. Pusher plates 1*b*, 1*b* are fixedly secured to the blocks 1*a*, 1*a*** so that their respective vertical positions may be adjusted.

A ring member 29 is fixedly secured to the outer periphery of the lower die 22 fitted so as to move vertically relative to the lower die set 3. Arms 30 project from the left and right sides of the ring member 29, each of the arms 30 rotatably supporting a pinion 32 through a support shaft 31. Further, holders 34 each having a fixed rack 33 meshing with the pinion 32 are fixedly secured to both sides of the lower die set 3. Further, a movable rack 35 is slidably fitted on the opposite side of the holder 34. This movable rack 35 meshes with the pinion 32 on the opposite side of the fixed rack 33. The upper end surface of the movable rack 35 abuts against the lower end of the pusher plate **1*b* so as to be moved downwards by the latter. The positional relationship between the upper end of the movable rack 35 and the lower end of the pusher plate 1*b* is such that after the upper and lower dies 9 and 22 are moved downwardly and upwardly, respectively, by the pressurized fluid supplied into the upper and lower fluid pressure chambers 5 and 19, and the slide 2 is moved downwardly thereby allowing the upper die 9 to contact with the lower die 22, the upper end of the movable rack 35 abuts against the lower end of the pusher plate 1*b***.

Figure 2:
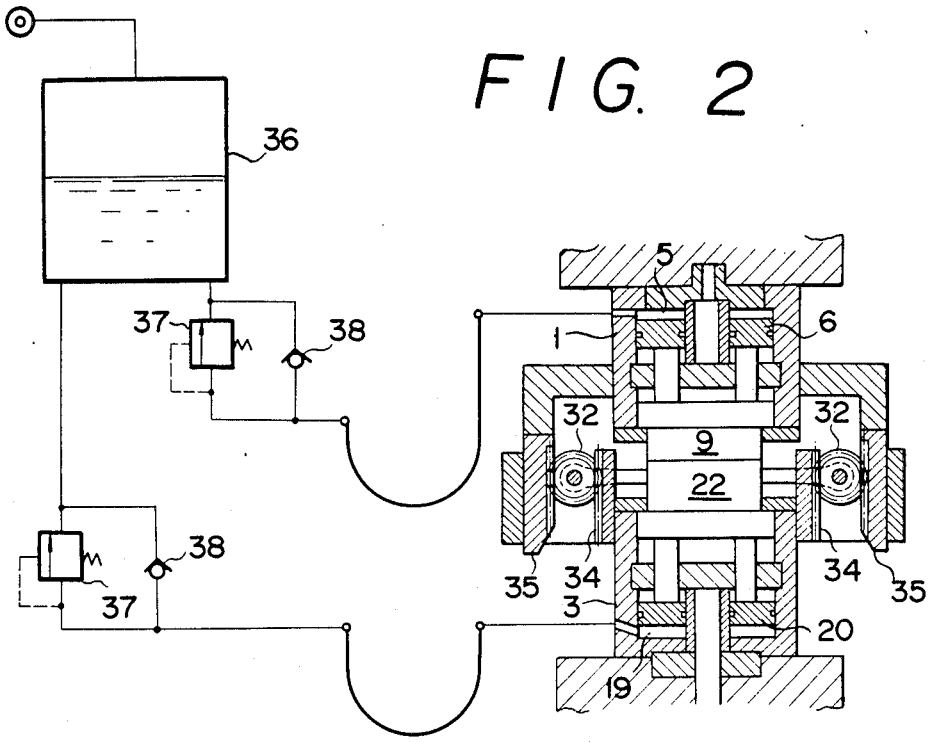
FIG. 2 is a hydraulic circuit diagram for use in one embodiment of die assembly according to the present invention.

As shown in FIG. 2, the fluid pressure chambers 5 and 19 are each connected through a set of relief valve 37 and check valve 38 to a tank 36 which is set at a predetermined pressure by an air pressure.

The operation of the above arrangement will now be described below.

After a blank "A" (a cylindrical blank is shown) is placed on the lower punch 23 within the lower die 22, the slide 2 is moved downwards. In the course of downward movement of the slide 2, after the upper die 9 is brought into contact with the lower die 22, the lower end of the pusher plate **1*b* fixedly secured to the upper die set 1 is allowed to contact with the upper end of the movable rack 35. The left half of FIG. 1** shows the condition at that time.

When the slide 2 is moved downwards further, the upper die 9 is moved upwards relative to the upper die set 1 and the lower die 22 is moved downwards relative to the lower die set 3. At that time, the upper and lower dies 9 and 22 are moved against the fluid pressure in the fluid pressure chambers 5 and 19 and movements of them are controlled by the pinion 32, the fixed rack 33 and the movable rack 35.

Stating in brief, when the slide 2 is moved further after the upper die 9 has been brought into contact with the lower die 22, the movable rack 35 is forced down to thereby rotate the pinion 32 clockwise. At that time, since the pinion 32 meshes also with the fixed rack 33, the support shaft 31 of the pinion 32 is moved downwards by half the downward displacement of the slide 2 by the differential action provided between the pinion 32 and the fixed and movable racks 33 and 35, and so the lower die 22 is moved downwards by the amount corresponding to the displacement of the support shaft 31. Accordingly, the upper die 9 kept into contact with the lower die 22 is allowed to move downwards by the amount corresponding to half the downward displacement of the slide 2. Whilst, the upper punch 11 is moved downward by the same stroke as that of the upper die set 1, and the lower punch 23 is kept fixed.

For this reason, both the dies 9 and 22 kept into contact with each other are moved downwards by the amount corresponding to half the stroke of the upper punch 11 so that the contact surfaces of the upper and lower dies 9 and 22 may always be kept in the positional relationship in the initial downward movement condition between the opposite surfaces of the upper and lower punches 11 and 23.

Stating in brief, if the contact surfaces of the upper and lower dies 9 and 22 are located at a position in the middle of the distance between the opposite surfaces of the upper and lower punches 11 and 23 at the time when the die 9 is brought for the first time into contact with the die 22 or at the commencement of the downward movement of the dies 9 and 22, then even with further movements of the slide 2, the contact surfaces of the dies 9 and 22 can always be kept at a position in the middle of the distance between the opposite surfaces of the punches 11 and 23. This implies that, if the upper and lower punches 11 and 23 are assumed to be fixed relatively, the upper and lower dies 9 and 22 will be moved or displaced, respectively, by the amount half the stroke of the slide 2 in the opposite directions, that is; the upper and lower dies 9 and 22 possess the same function as those of presses provided with upper and lower dies arranged to be moved towards each other at the same time.

During the above-mentioned action, the upper and lower dies 9 and 22 are moved against the fluid pressure applied in the upper and lower fluid pressure chambers 5 and 19. The fluid pressure within the chambers 5 and 19 is controlled by means of the relief valve 37.

Figure 3A:
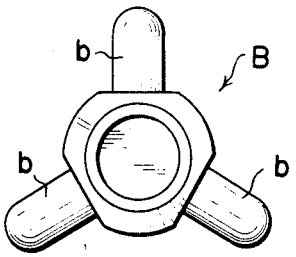
FIG. 3A is a plan view of a product shaped by a general type mechanical press machine with the die assembly according to the present invention.
Figure 3B:
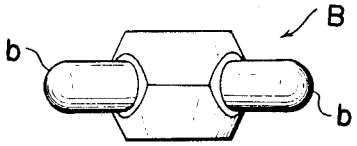
FIG. 3B is a side elevational view of the product shown in FIG. 3A.

In FIGS. 3A and 3B, there are shown plan view and side elevational view of a product obtained by press-shaping at the time when the above-mentioned embodiment of die assembly is actuated as mentioned above.

In the above-mentioned embodiment, there is described the case where the pinion 32 and the racks 33 and 35 which mesh with it forming the differential means for the upper and lower dies 9 and 22 have an equal gear ratio whereby allowing the upper and lower dies 9 and 22 to displace by the amount equal to half the stroke of the slide 2 in the opposite directions. Therefore, the product designated by reference character "B" obtained by press-shaping by means of the die assembly which fulfills the above-mentioned function has, as shown in FIG. 3B, transverse projections "b" formed in the vertically central position thereof.

Whilst, in case where it is desired to form the transverse projections "b" at a vertical position upper or lower than the horizontally central position, it is only necessary to divide the pinion 32 between a first sector portion and a second sector portion (both not shown), or to mount coaxially on a shaft a first pinion and a second pinion (both not shown) which differ in gear ratio, thereby making the meshing and actuating speeds of the fixed rack 33 and the movable rack 35 different.

Figure 4:
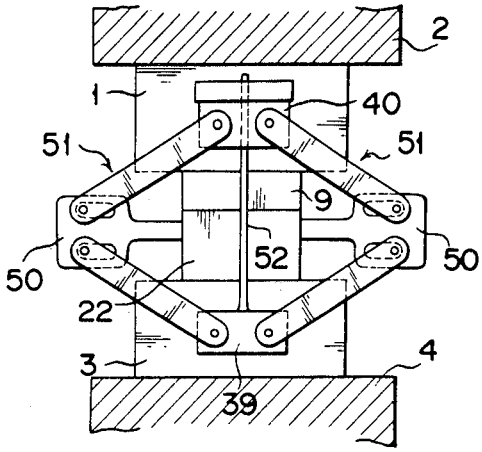
FIGS. 4 and 5 are front view and side elevational view, respectively, illustrating another embodiment of die assembly according to the present invention.
Figure 5:
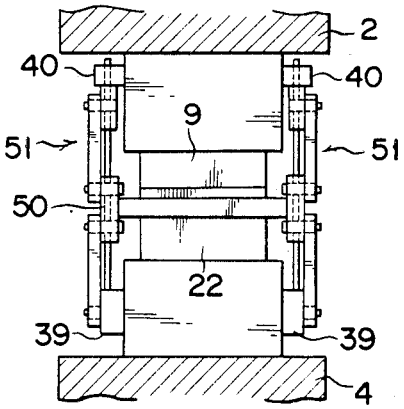
Figure 6:
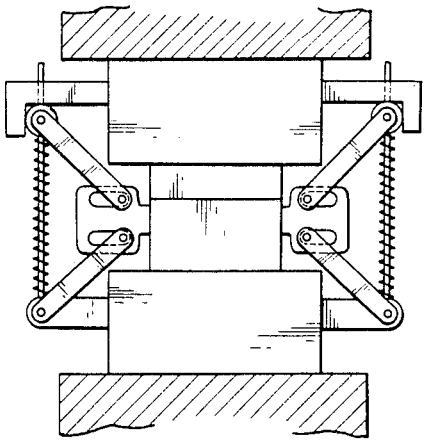
FIG. 6 is a plan view illustrating a further embodiment of die assembly according to the present invention.

While, in the above-mentioned first embodiment, an example of differential means employing a pinion and racks is illustrated, link mechanisms as shown in FIGS. 4, 5 and 6 may be used as the differential means.

In brief, in a second embodiment shown in FIGS. 4 and 5, upper and lower die sets 1 and 3 have link fulcrums 40 and 39 fixedly secured at symmetrical positions, respectively. Further, the lower die 22 has arms 50, 50 fixedly secured to and extending on the left and right sides from the die 22. The upper and lower link fulcrums 40 and 39 are connected to the left and right side arms 50, 50 by means of a pair of link mechanisms 51, 51 having a symmetrical configuration. Each link mechanism has a pair of link members. The connection between the link mechanisms 51, 51 and the arms 50, 50 is free in horizontal direction, but restrained in movement in the vertical direction. Reference numeral 52 denotes a rod adapted to restrain the transverse movements of the upper and lower link fulcrums 40 and 39, the lower end of the rod 52 being fixedly secured to the lower link fulcrum 39, and the upper end of which passing through the upper link fulcrum 40 so as to slide freely in the vertical direction.

FIG. 6 shows a third embodiment which employs a linkage mechanism incorporating the same principle as that of the second embodiment shown in FIGS. 4 and 5, but having a construction wherein the upper and lower link fulcrums are connected to the arms outside the die set.

In this third embodiment, there is no obstacle in front of dies, and therefore it is convenient for the operator to effect his operation.

It is to be understood that the foregoing description is merely illustrative of the preferred embodiments of the present invention, but that the present invention is not to be limited thereto, but is to be determined by the scope of the appended claims.

What we claim is:

1. A die assembly for use in a general type mechanical press machine comprising opposite upper and lower dies fitted in upper and lower die sets, respectively, means for freely sliding said die sets by a predetermined stroke, and a differential mechanism interconnecting said upper and lower dies so as to transmit a predetermined rate of displacement to said lower die in accordance with and in the same direction as the movement or displacement of said upper die set.

2. The die assembly as claimed in claim 1, wherein said differential mechanism. comprises pinion means rotatably supported by said lower die; a fixed rack fixedly secured to said lower die set and meshing with said pinion means; and a rack secured to said upper die set and located on the opposite side of said fixed rack so as to mesh with said pinion means and to move in synchronism with said upper die set.

3. The die assembly as claimed in claim 1, wherein said differential mechanism comprises linkage means having two pairs of link mechanism, each link mechanism comprising a pair of link members wherein respective one ends of said link members are pivotally connected to said upper and lower die sets, respectively, and respective other ends of said link members are pivotally connected to two arms fixedly secured to and horizontally extending on the left and right sides from the lower die, the pivotal connection of said other ends of said link members to said arms permitting said other ends of the link members to move freely in the horizontal direction, but to restrain movement in the vertical direction.

4. The die assembly as claimed in claim 3, characterized in that said respective one ends of the link members are pivotally connected to two other arms fixedly secured to an extending horizontally on the left and right sides from the upper and lower die sets.

* * * * *